United States Patent [19]

deBruyne

[11] 4,147,516

[45] Apr. 3, 1979

[54] OSCILLATORY MECHANISMS

[76] Inventor: Norman A. deBruyne, 3700 Brunswick Pike, Princeton, N.J. 08540

[21] Appl. No.: 785,674

[22] Filed: Apr. 7, 1977

[30] Foreign Application Priority Data

Apr. 9, 1976 [GB] United Kingdom ..... 14545/76
Apr. 27, 1976 [GB] United Kingdom ..... 17025/76

[51] Int. Cl.[2] ..... B06B 1/18; F01L 15/02

[52] U.S. Cl. ..... 422/99; 91/50; 366/116; 366/124; 366/273

[58] Field of Search ..... 259/72, 79; 91/50, 218, 91/229; 23/259

[56] References Cited

U.S. PATENT DOCUMENTS

| | | | |
|---|---|---|---|
| 2,378,979 | 6/1945 | Burt | 91/50 X |
| 2,447,312 | 8/1948 | Burt | 91/50 |
| 2,490,644 | 12/1949 | McGrew | 91/229 X |
| 2,554,212 | 5/1951 | Quinlan | 91/50 X |
| 2,804,777 | 9/1957 | Kerr-Lawson | 259/72 |
| 3,010,439 | 11/1961 | Mee et al. | 91/229 X |
| 3,224,737 | 12/1965 | Becker | 259/72 X |
| 3,228,522 | 1/1966 | Strand | 259/72 |
| 3,807,704 | 4/1974 | Janzen et al. | 259/72 |
| 3,889,472 | 6/1975 | Guillaud | 91/218 X |

*Primary Examiner*—Morris C. Wolk
*Assistant Examiner*—Roger F. Phillips
*Attorney, Agent, or Firm*—William F. Frank

[57] ABSTRACT

An oscillatory mechanism, designed particularly for use in a laboratory shaker, includes a member, or a system of members, arranged to perform oscillatory movements, the transmission of power to that member or system, whereby its oscillation is caused or maintained, being by means of fluid pressure, the mechanism comprising means defining one or more chambers each having an inlet connectible to a source of pressurized fluid and an outlet through which, when open, pressurized fluid supplied to each chamber can escape; the respective chamber being expansible under the action of said pressurized fluid when each said outlet is closed; and wherein the motion of the oscillatory member or system in operation cyclically opens and closes each said chamber outlet, the consequent expansion of the respective chamber upon closure of the outlet delivering an impulse to said member or system whereby the oscillation thereof is caused or maintained.

13 Claims, 11 Drawing Figures

OSCILLATORY MECHANISMS

BACKGROUND OF THE INVENTION

Field of the Invention

The present invention relates to oscillatory mechanisms of a type wherein a member, or a system of members, is arranged to perform oscillatory movements in operation of the mechanism, and it is an aim of the invention to provide mechanisms of this type wherein the transmission of power to that member or system, whereby its oscillation is caused or maintained, is by means of fluid pressure.

SUMMARY OF THE INVENTION

According to the invention there is provided a mechanism of the type stated above comprising means defining one or more chambers each having an inlet connectible to a source of pressurised fluid and an outlet through which, when open, pressurised fluid supplied to the or each chamber can escape; the respective chamber being expansible under the action of said pressurised fluid when the or each said outlet is closed; and wherein the motion of the oscillatory member or system in operation cyclically opens and closes the or each said chamber outlet, the consequent expansion of the respective chamber upon closure of the outlet delivering an impulse to said member or system whereby the oscillation thereof is caused or maintained.

In practice I have found it to be of advantage to include one or more flow-regulating restrictions in one or more lines by means of which pressurised fluid is supplied to the or each expansible chamber, the restriction being as close upstream to the chamber as possible. The use of such restrictions can lead to an advantageous reduction in the overall fluid consumption and an increase in the rate of fall of pressure within the chambers after expansion, without decreasing the rate of rise of pressure within the chambers when their outlets are closed to such an extent as to undesirably limit the frequency of oscillation of the member or system which opens and closes the outlets.

It is generally preferred that the oscillatory member or system is one which is naturally oscillatory independently of the expansible chamber so that once it has been set oscillating the expansible chamber need only deliver relatively low power impulses thereto sufficient to maintain oscillation at the natural frequency of the member/system. Nevertheless, it is equally within the scope of the invention that the oscillatory motion of the member or system be caused solely by the action of expansible chambers.

Again, it will normally be the case that the or each expansible chamber is mounted in a fixed position so disposed in relation to a portion of the oscillatory member or system that such portion closes the respective chamber outlet in the course of the motion of the member/system and receives the consequent impulse from the chamber. Nevertheless, it is equally within the scope of the invention for one or more chambers to themselves form part of an oscillatory system so that the respective chamber outlets are closed in the course of the motion of the system by contact with an adjacent stationary element or elements against which element the chamber reacts to deliver an impulse to the system.

All such variations as are discussed above will be exemplified subsequently.

The fluid pressure by which mechanisms according to the invention are operated may be either pneumatic or hydraulic but having regard to the fact that operation requires the intermittent excape of fluid from the expansible chamber pneumatic pressure will generally be preferred, the working fluid generally being air.

DESCRIPTION OF THE PREFERRED EMBODIMENTS

Figure 1:
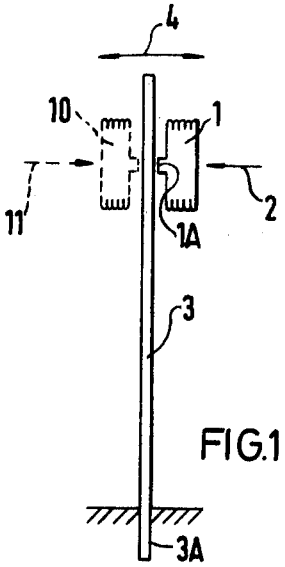
FIGS. 1 to 5 respectively illustrate, purely schematically, some simple examples of mechanisms which employ the principles of the present invention.

In each of FIGS. 1 to 5 reference numeral 1 indicates a respective chamber having an inlet connected, (via a flow-regulating restriction, not shown), to a source of pressurised fluid, (not shown), and an outlet at 1A through which, when open, pressurised fluid supplied to the chamber can escape. The chamber may comprise a flexible diaphragm or bellows so as to be expansible under the action of the pressurised fluid when the outlet 1A is closed, the chamber being so restrained that such expansion takes place in the sense of arrow 2.

Figure 2:
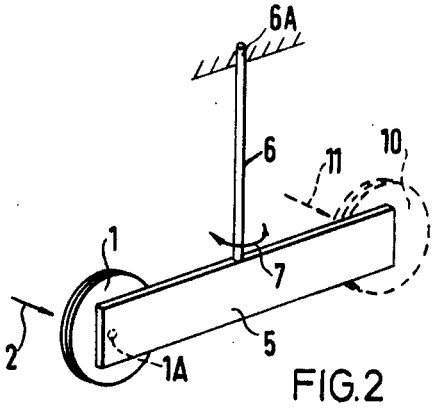

Referring to FIG. 1, the chamber 1 is in this case disposed adjacent to a spring leaf 3, rigidly anchored at one end 3A. The leaf can oscillate naturally, as indicated by arrow 4, flexing to the left and right, (in the sense of the Figure), of the median position in which it is illustrated, in the course of each excursion to the right the leaf coming into contact with and closing the outlet 1A of the chamber 1. Such closure of the outlet causes the chamber to expand in the sense of arrow 2, thus delivering a leftwardly directed impulse to the leaf whereby its oscillation is maintained. In FIG. 2 the chamber 1 is disposed adjacent to a plate 5 secured to one end of a torsionally resilient bar 6 rigidly anchored at its other end 6A, the system 5/6 oscillating naturally in the sense of arrow 7. As before, the chamber 1 is so disposed that in the course of its oscillation plate 5 comes into contact with and closes the outlet 1A, the consequent expansion of the chamber delivering an impulse to the plate in the sense of arrow 2 whereby the oscillation of the system is maintained.

Figure 3:
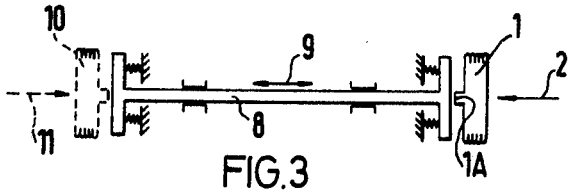

In FIG. 3 the chamber 1 is disposed adjacent to a member 8 resiliently borne so as to reciprocate naturally, as indicated by arrow 9, to the left and right, (in the sense of the Figure), of the median position in which it is illustrated. Again, in the course of each excursion to the right the member 8 comes into contact with and closes the outlet 1A of the chamber 1, the consequent expansion of the chamber delivering a leftwardly directed impulse to the member whereby its reciprocation is maintained.

In any of the embodiments described above with relation to FIGS. 1 to 3 a second expansible chamber 10 similar to chamber 1 may be added, the second chamber being arranged to deliver an impulse to the appropriate oscillating system in the direction of arrow 11 and out of phase with the first by one half of a cycle.

Figure 4:
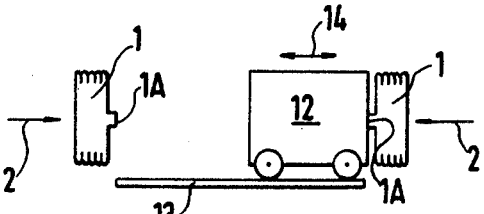

FIG. 4 illustrates a mechaism in which a pair of expansible chambers 1 are employed to oscillate a member in a manner which is not a natural motion of the member 12 in the absence of the chambers, in contrast to the other mechanisms so far described with relation to FIGS. 1 to 3. In this case, the member is exemplified as being constrained to run on a straight track 13 along which it shuttles in the sense of arrow 14 between the two chambers 1, each time a chamber is encountered the member 12 being arrested and closing the respective outlet 1A, the consequent expansion of the chamber delivering an impulse to the member to return the member to the other chamber.

Figure 5:
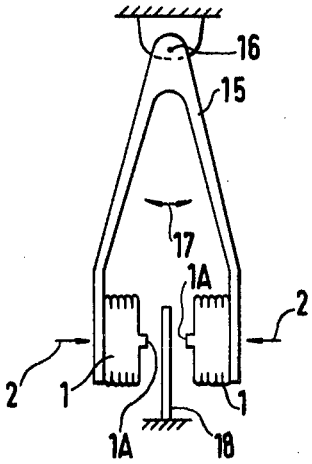

In FIG. 5 a pair of chambers 1 are mounted at the ends of respective legs of a fork 15 pivotted at 16 so as to perform an oscillatory rocking motion in the sense of arrow 17. In the course of this motion the outlets 1A of the chambers alternately come into contact with, and are closed by, a stationary element 18, the consequent expansion of the chambers reacting against element 18 so as to deliver respective impulses to the fork in the opposite senses of direction to the arrows 2, whereby the motion of the fork is maintained. In this case, it will be noted, the chambers 1 themselves form a part of the oscillating system, in contrast to the mechanisms so far described with relation to FIGS. 1 to 4. It will be appreciated however, that in any of the mechanisms of FIGS. 1 to 4 the chambers 1 and 10 could, instead of being located in a fixed position so as to be cyclically contacted by the members 3, 5, 8 or 12, be mounted on those members so as to cyclically contact fixed elements in the nature of the mechanism of FIG. 5.

It will be appreciated that it is the intention of FIGS. 1 to 5 merely to indicate some simple examples of the types of motion with which mechanisms according to the invention may operate, and they are not in themselves intended to represent complete practical embodiments of such mechanisms. In practice, mechanisms according to the invention may comprise oscillatory systems having a member which moves in the fashion of one of the elements 3, 5, 8, 12 or 15 (or with a more complicated motion), and through which the oscillation of the system is caused or maintained so that, for example, member 8 in FIG. 3 might correspond to a portion of a linear vibratory conveyor and member 5 in FIG. 2 might correspond to a portion of a spiral vibratory conveyor. It is also proposed for mechanisms according to the invention to be employed for driving other mechanisms, wherein the oscillatory motion caused or maintained by the expansible chamber is merely an intermediate stage from which a further motion is derived. Thus, for example, the oscillatory motion of embodiments such as those shown in FIGS. 2 and 5 may be converted into a unidirectional stepwise rotary motion by a suitable "freewheel" device or other escapement to drive e.g. a so-called magnetic stirrer.

Figure 6:
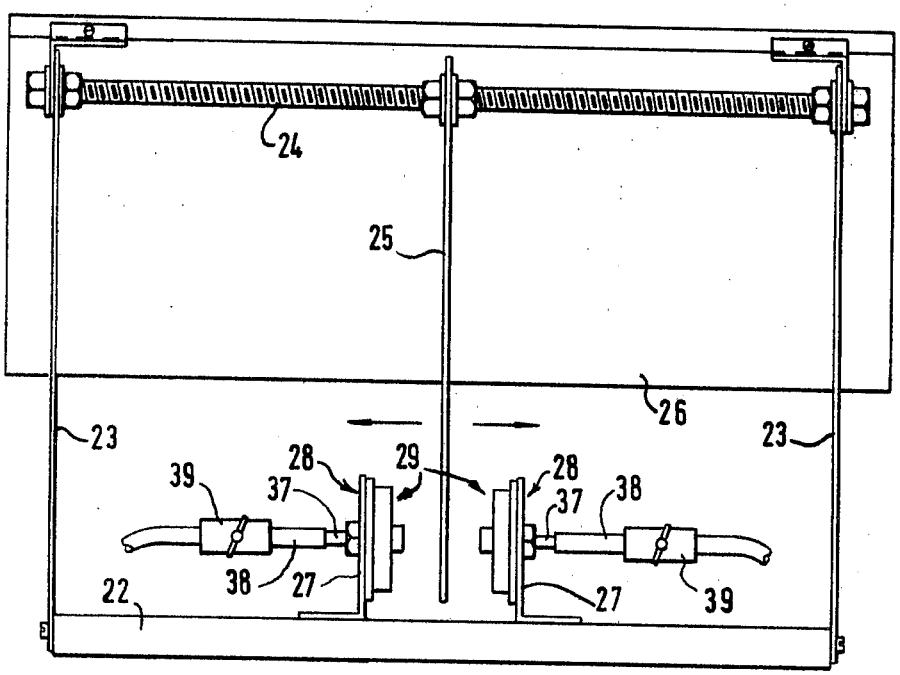
FIGS. 6 and 7 are respectively side and end elevation views of a practical laboratory shaker according to the invention.
Figure 7:
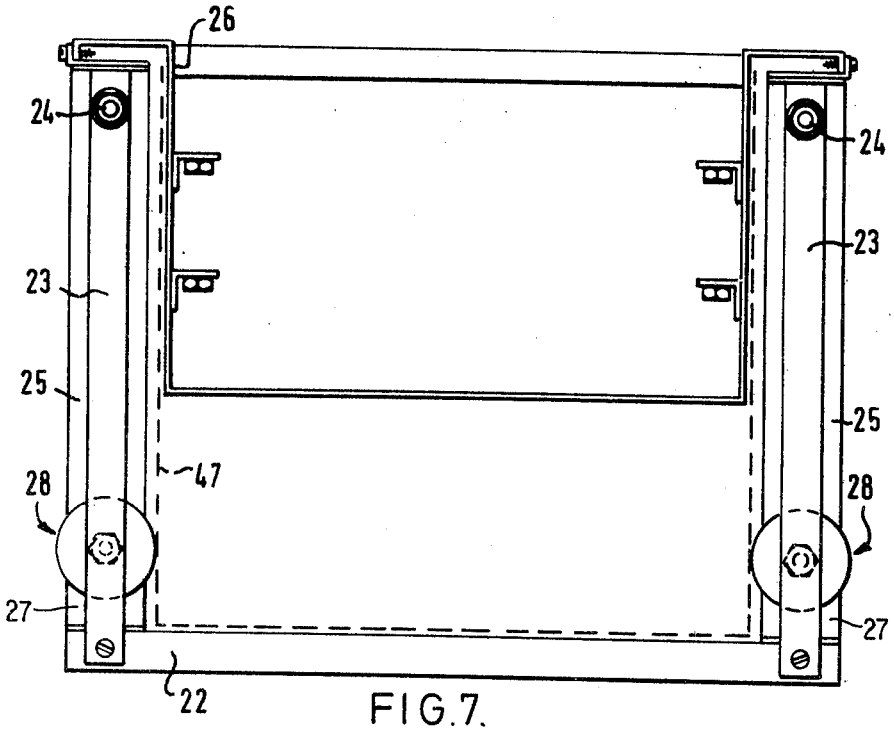

Turning now to FIGS. 6 and 7, these illustrate a practical embodiment of a mechanism according to the invention in the form of a laboratory shaker. This comprises a rigid baseplate 22 to which are anchored the bottom ends of four upstanding spring steel strips 23. The strips are arranged in two parallel pairs, the members of each pair being connected at their upper ends by respective rigid rods 24. Rigidly depending for the midpoint of each rod 24 is a respective rigid plate 25, and borne between the rods 24 is a tray 26 adapted to support laboratory flasks, test tubes or the like for agitation. The elements 23, 24, 25 and 26 together with the contents of the tray, define the oscillatory system of the mechanism and it will be appreciated that the natural oscillatory motion of this system is with the strips 23 flexing leftwardly and rightwardly in the sense of FIG. 6, the rods 24, plates 25 and tray 26 substantially reciprocating (at the contemplated amplitude of flexure of the strips 23).

Also secured to the baseplate 22 by means of brackets 17 are four expansible chamber assemblies 28, one disposed to each side of each plate 25 as shown in FIG. 6. Details of the construction of each assembly 28 are disclosed in FIG. 8. Referring to that Figure, reference numeral 29 denotes a diaphragm element in the form of an elastomeric moulding of e.g. neoprene or silicone rubber, which element comprises a circular base 30 from which extends a coaxial annular skirt 31 terminating in an inwardly directed coaxial annular lip 32 parallel to, and spaced from, the base. The base is formed with an annular kink 33 to facilitate the expansion of the chamber described below, and also has on the side opposite the skirt 31 a centrally disposed boss 34. Extending through the base and boss is a bore 35.

Sealedly received within the annular recess defined between the base, skirt and lip of element 29 is a rigid disc 36 which is integral with or attached to a rigid tube 37. The disc 36 is itself radially recessed as shown in the Figure and there is accordingly defined between the disc and the base of element 29 a chamber 38 which communicates with the bore 35 of element 29 and the bore 39 of tube 37. The tube is externally screwthreaded at 40 and a nut 41 is screwed onto the tube to secure the assembly to bracket 27, the lip 32 of element 29 being clamped between disc 36 and a rigid annular backing plate 42 having a flange 42A which prevents any tendency of the element 29 to be distorted radially outwardly as the nut 41 is tightened.

In operation, the free ends of the tubes 37 of each assembly 28 are connected by flexible tubing 38 (FIG. 6) to a common source of pressurised air, such as a small air pump or compressed air cylinder, (not shown), regulated to deliver at a gauge pressure of only units of p.s.i., the respective lengths of tubing connected to each tube 37 incorporating flow-regulating restrictions 39 immediately upstream of the tubes 37. So long as the plates 25 remain out of contact with the diaphragm elements 29 it will be appreciated that the air supplied to each chamber 38 will simply vent to atmosphere via the outlets defined by the respective bores 35, although the loss of air will not be great at the low working pressure contemplated.

Figure 8:
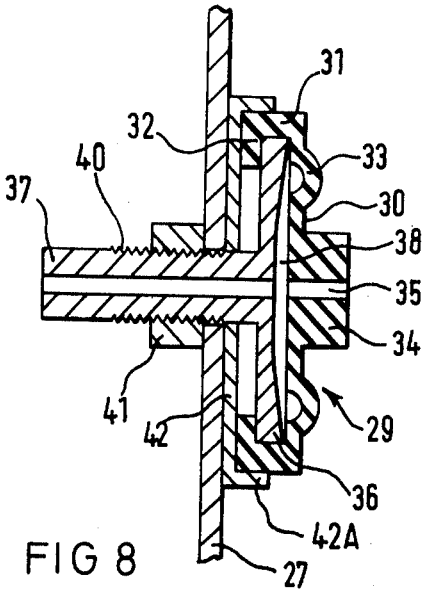
FIG. 8 illustrates in section a detail of the shaker of FIGS. 6 and 7.

From a consideration of FIG. 6 however, it will also be appreciated that once the system 23/24/25/26 has been set osciallating each plate 25 will alternately come into contact with the bosses 34 of the diaphragm elements 29 disposed to either side of the plates, the plates effectively closing the respective chamber outlets 35 by such contact. Closure of an outlet 35 causes the respective chamber 38 to pressurise so that the portion of the base of the respective diaphragm element 29 from kink 33 inwards is thrust away from the recessed surface of disc 36 thereby imparting a small impulse to the respective plate 25. In the embodiment of FIGS. 6 to 8 such an impulse is applied to each plate 25 at the end of each leftward and rightward excursion (in the sense of FIG. 6), these impulses being sufficient to maintain the systems 23/24/25/26 in a constant state of oscillation at its natural frequency.

It is believed that a laboratory shaker of the form described above has considerable advantages over conventional laboratory shakers, which latter usually comprise a table to which is attached an electric motor driving an eccentric weight, or a tray which is reciprocated by an electric motor via a crank or similar mechanism. The pneumatically driven shaker described above does not require the provision of an electric motor, (and if such a motor is used to drive an air pump for the shaker this can be substantially remote from the shaker), and can accordingly be safely used in the presence of flammable vapours or combustible dust where the use of conventional shakers would involve the risk of explosion. When operating in an atmosphere which requires complete protection from the presense of oxygen the shaker can be operated from a pressurised source of inert gas, such as nitrogen, instead of air. The shaker is quiet in operation, consumes relatively little power, and once in operation can very readily be stopped and then restarted simply by arresting the motion of the tray by hand and then displacing the tray by hand, without having to interrupt the air supply to the expansible chambers. Changes in the frequency of oscillation can be effected by changing the inertia of the oscillatory system (e.g. by adding or removing weights from the tray), or by changing the flexural characteristics of the strips 23, (e.g. by effectively shortening or lengthening them by applying clamps at some point between their ends), and changes in the amplitude of oscillation can be effected e.g. by changing the distance by which the opposed pairs of expansible chamber assemblies 28 are spaced apart, together perhaps with a change in the applied air pressure. In order to achieve agitation of the tray's content at a temperature other than ambient, a temperature-controlled water bath may be added to the apparatus as indicated at 43 in FIG. 7. It will be observed that whilst tray 26 is disposed within the bath the remaining elements 23/24/25 of the oscillating system together with the chamber assemblies 28, are disposed without the bath.

In a modified form of the shaker just described, the plates 25 are dispensed with and the expansible chambers are arranged to act directly upon the strips 23. In fact I have found it sufficient for one only of the strips 23 to be acted upon in this way, and such an arrangement may take the form illustrated in FIG. 9.

Figure 9:
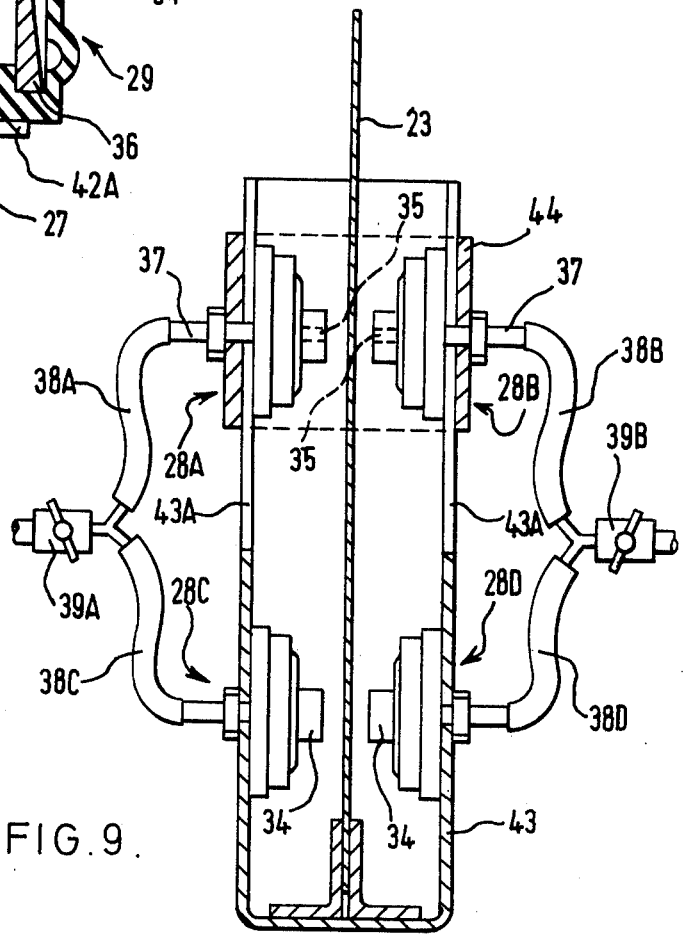
FIG. 9 illustrates, partly in section, a detail of a modified form of the shaker of FIGS. 6 and 7.

Referring to FIG. 9, the single strip 23 has four expansible chambers assemblies 28A to 28D associated therewith, the chamber assemblies being located by a support element 43 and arranged in two opposed pairs 28A, 28B and 28C, 28D. In operation, each opposed pair of chambers acts upon the strip 23 to maintain the oscillatory system in motion in a manner similar to that in which the chamber pairs act upon the plates 25 in the embodiment of FIGS. 6 and 7, in the present case chamber 28A acting in parallel with chamber 28C and chamber 28B acting in parallel with chamber 28D. In such an arrangement it is advantageous to synchronise the action of the parallel chambers by putting them into a master-and-slave relationship. Thus, whereas the diaphragm elements of assemblies 28A and 28B are provided with outlets 35 as before, the diaphragm elements of assemblies 28C and 28D have solid bosses 34 with no such outlets. Assembly 28C is connected to the pressure source (not shown) in parallel with assembly 28A through flexible tubing 38A and 38C and a common restriction 39A whilst assembly 28D is connected to the pressure source in parallel with assembly 28B through flexible tubing 38B and 38D and a common restriction 39B, the pressure within both chambers 28A and 28C being determined by the opening and closing of the outlet of 28A and the pressure within both chambers 28B and 28D being determined by the opening and closing of the outlet of 28B.

In the embodiment of FIG. 9 the amplitude of oscillation of the illustrated strip 23, and thereby of the entire oscillatory system, can be changed by changing the elevation of the pair of chamber assemblies 28A and 28B. To this end those assemblies are mounted upon a carriage 44 vertically slidable upon support element 43, the tubes 37 of the chamber assemblies passing through respective vertical slots 43A. The carriage can be locked to the support element by any suitable means, such as a set screw, (not shown), in any position with the range of travel permitted by slots 43A.

Figure 10:
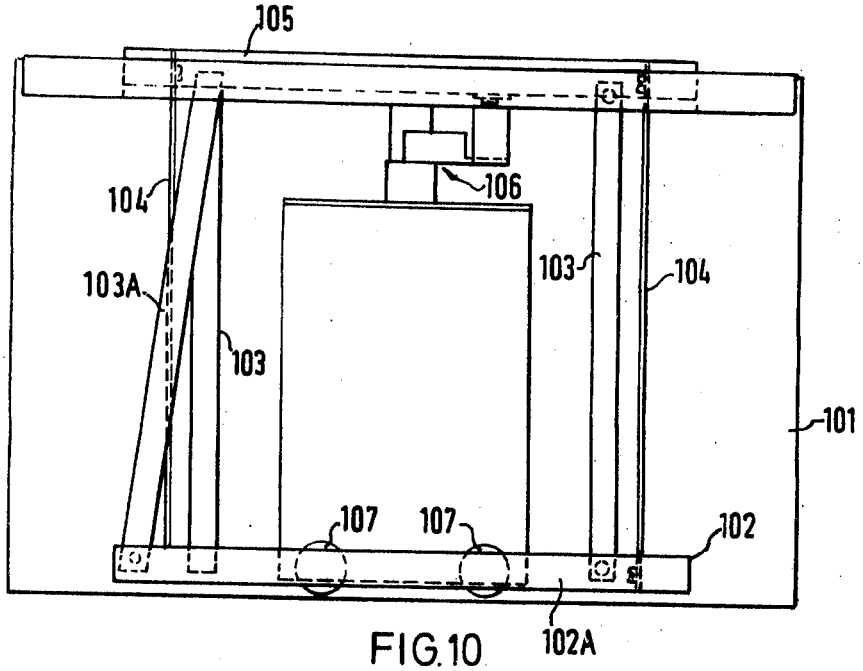
FIG. 10 shows in elevation another laboratory shaker.

Referring to FIG. 10, the illustrated shaker comprises an outer casing 101 within which is suspended a frame 102 of rectangular planform. The frame 102 is suspended by four spring steel strips 103 in a similar arrangement to that of the strips 23 in FIGS. 6 and 7, the strips 103 being rigidly anchored at their upper ends and conferring upon frame 102 the ability to perform an oscillatory motion relative to casing 101, at the contemplated amplitude of flexure of the strips 103 the motion of frame 102 being substantially reciprocatory. Supported by frame 102, upon a similar series of four spring steel strips 104, is a second rectangular frame 105. As illustrated, the planes of the strips 104 are perpendicular to the planes of the strips 103 so that frame 5 can perform an oscillatory motion relative to frame 102, (similar to the motion of the tray 26 relative to the baseplate 22 in FIGS. 6 and 7), which is perpendicular to the motion of the frame 102 relative to casing 101. Thus, when the entire system 102, 103, 104, 105 is set oscillating frame 105 is adapted to perform a motion relative to casing 101 which is the vector sum of the two above-described perpendicular motions, and this motion is regulated by a crank mechanism 106 linking casing 101 and frame 105 so that the frame performs a circular orbital motion in a horizontal plane. The frame 105 supports a table upon which laboratory flasks or the like can be secured for agitation.

Secured to the casing 101 adjacent to the side 102A of the lower frame 102 are a parallel pair of expansible chamber assemblies 107 similar to the assemblies 28 illustrated in FIG. 8, to further such assemblies (not shown), being provided adjacent to the side of the frame 102 opposite to side 102A. In operation, the expansible chamber assemblies are connected via flow-regulating restrictions to a source of pressurised air and, once the system 102, 103, 104, 105 has been set oscillating, they maintain the entire system in oscillation at its natural frequency by the delivery of impulses to the substantially reciprocatory frame 102 in an entirely analogous manner to that in which the corresponding assemblies act in the laboratory shakers of FIGS. 6 to 9. However, it is possible to force the system to oscillate at higher frequencies than the natural frequency by increasing the air pressure supplied to the expansible chambers. The action of the chambers in each parallel pair is preferably synchronised by putting them into a master-and-slave relationship as in the embodiment of FIG. 9.

The shaker described herein has the same advantages of explosion-proofness, low power consumption, quietness and ease of operation as are enjoyed by the shakers of FIGS. 6 to 9. It has the additional advantage, however, that it agitates with an orbital rather than a reciprocatory motion and is thereby adapted to swirl liquids, this being particularly desirable in microbiological and tissue culture work.

If required, additional, inclined strips 103A may be provided for bracing the strips 103 against shear displacements during the oscillation of the shaker.

Figure 11:
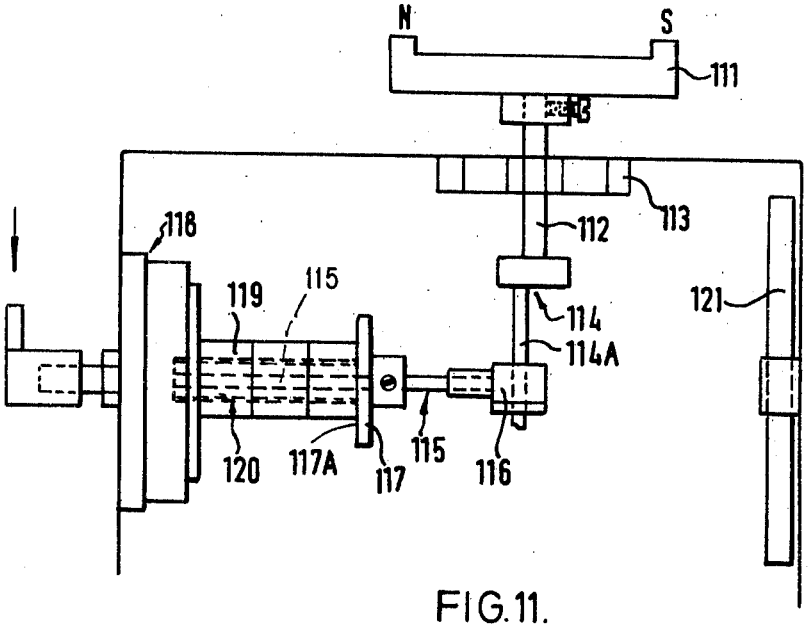
FIG. 11 shows in elevation a drive unit for a magnetic stirrer.

Turning now to FIG. 11, the illustrated magnetic stirrer device unit comprises a horizontally aligned permanent magnet 111 fast on a shaft 112 which is borne for rotation about a vertical axis by a ball bearing 113. In use, the magnet 111 is employed to rotate a second magnet (not shown) within a vessel of liquid to be stirred, as is conventional. The shaft 112 is arranged to be rotated by a crank 114. The crank 114 is in turn arranged to be driven by the oscillation of a horizontal rod 115, the crank pin 114A being borne by a low-friction plastics moulding 116 (e.g. of polypropylene), fast on one end of the rod 115. Rigid with the rod 115 is a plate 117 having a plane face 117A perpendicular to the axis of the rod.

The drive unit further comprises an expansible chamber assembly 118. This assembly is of a similar form to the assemblies 28 illustrated in FIG. 8, but its diaphragm element has an extended, bored boss 119 which is lined by a brass tube 120 communicating with the interior of the expansible chamber. The end of rod 115 remote from its connection to the moulding 116 lies loosely within tube 120, that is to say it does not occupy the full internal cross-section of the tube but leaves a space through which the interior of the expansible chamber can communicate with atmosphere.

In operation, the expansible chamber assembly is connected via a flow-regulating restriction to a source of pressurised air, as before. The disposition of parts is such that as magnet 111 rotates rod 115 performs a generally reciprocatory motion, (subject to the eccentricity of crank 114), with the face 117A of plate 117 cyclically opening and closing the passage provided from the interior of the expansible chamber to atmosphere. Accordingly, in the manner described hereinbefore, once the rotation of magnet 111 has been initiated the expansible chamber cyclically delivers impulses to the plate 117 to maintain the magnet 111 in rotation. Since in this case the overall mechanism is not naturally oscillatory, the frequency of oscillation, (or in other words the rotational speed of magnet 111), can be varied quite widely by varying the strength of the impulses delivered by the expansible chamber, viz by varying the applied air pressure.

In order to ensure that the drive unit is self-starting, i.e. to ensure that the expansible chamber is sealed and will thereby deliver an initial impulse when the air supply is first connected, a stationary magnet 121 may be employed to influence magnet 111 to move the mechanism into the appropriate initial position, this influence of course being overcome when the air supply is connected.

As in the case of the shaker described with reference to FIG. 10, the described drive unit is explosion-proof, consumes little power, is easy to operate and quiet in operation. It also has the advantage over conventional electric-motor drive units of generating no perceptible heat below the rotating magnet, heat generation being a considerable problem with electric-motor drive units, particularly in microbiological and tissue culture work. I have found a drive unit of the type described to be effective in typical "light duty" stirring at a rotational speed of, say, 100 R.P.M. (revolutions per minute) with an overall air consumption of about 3.5 liters/minute at a supply gauge pressure of 3 to 4 p.s.i. (pounds per square inch). This corresponds to a power consumption of about 2.2 watts and compares very favourably with a typical conventional drive unit employing a 25 watt shaded pole motor, the greatest proportion of the power consumed by which is represented by the generation of useless and undesirable heat.

Although the expansible chamber/crank mechanism of FIG. 11 has been described in terms of its use in driving a magnetic stirrer it will be appreciated that such a mechanism will be of use in many other situations calling for a low-power rotary drive.

Three such expansible chamber assemblies 118 having connecting rods 115 acting on a common crank pin and spaced apart around the pin at 120° intervals can be used for the generation of a three-phase fluctuating air supply suitable for driving the three-phase "A.C.A." stirrers described in the Complete Specification of my co-pending British Patent Application No. 3523/76. In such arrangement pressurised air would be supplied simultaneously to each chamber via individual restrictions, the fluctuating pressure within each chamber caused by the cyclic opening and closing of its outlet being tapped off to an individual stirring motor diaphragm assembly in the three-phase stirrer.

I claim:

1. A mechanism for oscillatory movement of at least one part of said mechanism comprising at least one member of said part having flexibility and being secured to, and so positioned on, said mechanism so that at least a portion of said member can be moved in an oscillatory path and a pair of means mounted on said mechanism adjacent said at least one portion for transmission of motion to said at least one portion, said at least one motion transmission means comprising at least one expansible chamber assembly having an inlet for a pressurized gaseous medium, a valveless outlet and an open passageway between said inlet and said outlet whereby said medium will flow through said assembly until said outlet is closed, and means connecting said inlet to a source of said pressurized medium;

said at least one portion of said member forming a valve to close said outlet when the oscillatory path of said at least one portion brings said at least one portion into contact with said outlet thereby causing said chamber to be expanded under the action of said pressurized medium to impart motion to said at least one portion in a direction opposite to the motion of said at least one portion when it closed said outlet thereby removing said at least one portion from its closure relationship with said outlet as said at least one portion moves toward said other motion transmission means.

2. A mechanism as defined in claim 1 wherein at least one flow-regulating restriction is included in at least one line by means of which pressurised fluid is supplied to the expansible chamber, the restriction being close upstream to the chamber.

3. A mechanism as defined in claim 1 wherein the at least one oscillatory member has a natural oscillatory frequency so that once it has been set oscillating the at least one expansible chamber delivers relatively low power impulses thereto sufficient to maintain oscillation at the natural frequency of the at least one member.

4. The mechanism according to claim 3 wherein the natural oscillatory frequency is modified by changing the inertia of said at least portion of said member.

5. The mechanism according to claim 3 wherein the frequency of oscillation is modified by changing the structural characteristics of said at least portion of said member.

6. The mechanism according to claim 3 wherein the amplitude of the natural oscillatory frequency is changed by modifying the distance by which said motion transmission means are spaced from said at least one portion.

7. A mechanism as defined in claim 1 wherein the chamber comprises a diaphragm sealed around its periphery to a rigid support, said outlet being an opening in the diaphragm, said inlet being an opening in the rigid support.

8. A laboratory shaker comprising a support for an object to be shaken and a mechanism for imparting oscillatory motion to said support, said mechanism comprising a base; upstanding flexible means secured at their lower ends to said base and attached at their upper ends to said support; at least a pair of motion transmission means mounted on said base in opposing relationship, each of said motion transmission means comprising a support element, an expansible chamber secured at its base to said support member and having an open outlet, inlet means on said support for a pressurized gaseous medium to enter and flow through said chamber and means connecting said inlet to a source of said pressurized medium;

rod means interconnecting the upper ends of said flexible means independent of said support; and means intermediately mounted on said rod means and depending therefrom between said opposed power transmission means, said depending means forming a valve with said outlet means when said depending means are moved into contact with said outlet for closure of same thereby causing expansion of said chamber with which said depending means is in closure contact, said expansion of said chamber imparting motion to said plate in the direction of said opposed power transmission means to release said plate from said closure relationship with said one power transmission means and move said plate in oscillating path to said opposed power transmisson means.

9. A shaker as defined in claim 8 wherein said flexible means comprise a plurality of spring strips are each anchored at one end thereof to a base, the strips being interconnected so as to oscillate in unison and the strips supporting said holder or support.

10. A laboratory shaker comprising a support for an object to be shaken and a mechanism connected to said support to provide oscillatory motion thereto, said mechanism comprising a base; flexible means secured to each opposing end of said base in an upright manner and secured at the upper end of said flexible means to said support; rod means interconnecting the upper ends of said flexible means independent of the connection of said flexible means to said support; and at least one pair of power transmission means mounted on said base on each side of at least one of said flexible means in opposed relationship to each other, each of said power transmission means comprising a support attached to said base, an expansible chamber having its base secured to said support, an outlet in said chamber adjacent said flexible means, an inlet opposingly positioned to said outlet to receive a supply of a pressurized gaseous medium, means connected to said inlet and a source of supply of said pressurized medium; said flexible means forming a valve to close said outlet of one of said opposed chambers when said flexible means is moved into contact therewith, the closing of said outlet causing said expansible chamber to expand in a direction toward said opposing power transmission means and thereby imparting motion to said flexible means away from said one expanded chamber toward said opposing chamber to cause said flexible means to move into closure contact with said opposing chamber.

11. A laboratory mechanism for providing orbital motion comprising an outer casing; a first frame suspended within said outer casing by four flexible members arranged in pairs along opposing sides of said frame, said flexible members being rigidly anchored at their upper ends to said casing;

a second frame positioned within said casing above said first frame and supported by two pairs of opposing flexible members secured to said lower frame and to said upper frame respectively, the flexible members supporting said second frame being perpendicular to the flexible members supporting said first frame;

a pair of expansible chamber motion transmission means mounted on the inner surface of said casing adjacent each of the sides of said first frame to which said flexible support members for said first frame are secured, a source of a pressurized gaseous medium for each of said motion transmission means;

a third frame supported at its lower end on said first frame and extending upwardly toward said second frame, a crank mechanism mounted on an upper surface of said third frame and connected to said second frame to impart orbital motion to said second frame when said first frame is oscillated by said motion transmission means.

12. A magnetic stirrer for laboratory use comprising a frame and a horizontally-positioned permanent magnet journaled on the upper surface of said frame; a crank mechanism to rotate said magnet; means to rotate said crank mechanism comprising an expansible chamber assembly mounted on a vertical member of said frame, said expansible chamber assembly having an inlet for a source of pressurized fluid medium and an outlet interior of said frame, a rod movably positioned within said outlet of said assembly and having intermediate its length a flat plate adapted to form a closure for said outlet of said expansible chamber, a bushing secured to the end of said rod opposite said expansible chamber, said bushing being connected by a shaft to said crank assembly;

means positioned on the vertical member of said frame opposite said expansible chamber to align said magnet to initially close said outlet of said expansible chamber; and means to provide a source of pressurized gaseous medium to said expansible chamber.

13. The magnetic stirrer according to claim 12 wherein the means to rotate said crank mechanism comprises three expansible chamber assemblies each having a connecting rod acting on a common crank pin and spaced apart around said pin at 120° and intervals for the generation of a three phase fluctuating air supply to a three phase stirrer connected to said crank mechanism.

* * * * *